United States Patent [19]

Saitoh et al.

[11] 4,191,114

[45] Mar. 4, 1980

[54] FURNACE ADAPTED FOR BURNING CITY-, INDUSTRIAL AND THE LIKE WASTES

[75] Inventors: Shigeru Saitoh; Noboru Suzuki, both of Iwaki, Japan

[73] Assignee: Kureha Kagaku Kogyo Kabushiki Kaisha, Tokyo, Japan

[21] Appl. No.: 863,664

[22] Filed: Dec. 22, 1977

[30] Foreign Application Priority Data

Dec. 24, 1976 [JP] Japan ..... 51/155070
Feb. 10, 1977 [JP] Japan ..... 52/012976

[51] Int. Cl.[2] ..... F23G 5/00
[52] U.S. Cl. ..... 110/248; 110/259
[58] Field of Search ..... 110/245, 248, 259, 255, 110/346

[56] References Cited

U.S. PATENT DOCUMENTS

| | | | |
|---|---|---|---|
| 3,225,721 | 12/1965 | Rowley | 110/259 |
| 3,577,938 | 5/1971 | Muirhead et al. | 110/245 |
| 3,946,680 | 3/1976 | Laman | 110/346 |

*Primary Examiner*—Kenneth W. Sprague
*Attorney, Agent, or Firm*—Fleit & Jacobson

[57] ABSTRACT

The invention relates to a furnace assembly adapted for the combustion of wastes. Its grating is arranged tiltable and a mass of mineral particles is mounted on the latter and for acting as a provisional and stationary furnace bed.

8 Claims, 4 Drawing Figures

FURNACE ADAPTED FOR BURNING CITY-, INDUSTRIAL AND THE LIKE WASTES

BACKGROUND OF THE INVENTION

This invention relates to improvements in and relating to a burning furnace adapted for the combustion of wastes such as city- and/or industrial wastes.

Burnable wastes, dusts and/or garbages discharged from our daily life are subjected to gradual change in their kind and nature with rapid improvement of the living standard. More specifically, these wastes have lesser and lesser water contents and larger and larger synthetic resin contents as the civilization advances. In this respect, conventional wastes burning furnaces, especially of small capacities, have been designed to treat such wastes as of rather lesser heat calories, and it has been found that when such conventional furnaces are utilized to burn out high caloric wastes abundant of synthetic resin contents, too much amount of excess calories and corrosive and errosive gases are generated during the burning service so that the metallic gratings and the like furnace components may soon be injured. Therefore, conventional wastes burning furnace, it is substantially impossible to burn plastics wastes. Thus, it is desired among those skilled in the art to provide a burning furnace adapted for burning plastics wastes or those containing abundantly plastics.

When plastics-containing wastes are being burnt, the combustion air must be supplied more abundantly than otherwise. If the flow of the supplied air is not evenly distributed, the burning becomes incomplete and the exhaust gases include a large amount of soot. In addition, tarry substances will be produced and flow down to the grating which is thus clogged. Further, the exhaust gases include corrosive components such as HCl; $SO_2$; $SO_3$ and/or HCN which attack corrosively the grating, ash scraper and the metallic parts of and for the furnace.

For solving the above problems, we, as coinventors, have already proposed a large size burning furnace which is provided with a conveyor arranged at the bottom thereof and a layer of mineral particles is continuously provided so as to form a furnace bed which is adapted for burning the wastes casted thereon and taking out unburnt residuals from the downstream end of the moving conveyor (refer to Japanese Patent Application Sho-46-101, 925 matured into Japanese Patent No. 830,943). By the provision of the layer of mineral particles, acting as the furnace bed, any contact of the waste under burning and of the exhaust gases developed, with the metallic constituents of the furnace, can be effectively avoided and it is possible to supply a plenty of air through the pervious furnace bed and for the combustion purpose and to realize complete combustion of the wastes by avoiding otherwise possible clogging of the grating by sticky and tarry burning residual which may flow down from the waste mass towards the grating.

With such large size burning furnace as above described and having a movable furnace bed of large operating surface area adapted for treating large amount of the wastes to be burnt, it has been found that substantial difficulty in effective supply of the combustion air into the combustion chamber of the furnace, and indeed, through the moving furnace bed from below. In order to satisfactorily supply the combustion air in the required large amount, it is necessary to cover and enclose the lower part of the furnace, including the conveyor, so as to form a kind of pressure air chamber in and by the enclosure. Since the unburnt residual is taken out together with the mineral particles forming the furnace bed, and then, the both these must be continuously sieved out from each other, so as to reutilize the thus separated mineral particles again as the renewed furnace bed material, upon having been conveyed back to the initial conveyor by means of a separate conveyor. Thus, the whole arrangement of this type of burning furnace becomes too much large and complicated to be practically adopted.

On the other hand, smaller capacity burning furnaces than 10 tons per day, having substantially no metallic parts liable to contact with burning material and/or combustion gases and a stationary furnace bed, are highly desired by and among the consumers.

However, when it is desired to provide a wastes-burning furnace fitted with a stationary grating having a layer or mass of mineral particles, in order to dispense with such metallic furnace component(s) as liably contacting the combustible material and/or the combustion gases, substantial difficulty will be met in the provision of the pervious mineral furnace bed and in the discharge of the ash and the like unburnt residual, especially adapted for use with smaller capacity burning furnace for burning plastics-abundant combustion material.

It is therefore the main object of the present invention to provide an economical and smaller capacity burning furnace having a stationary type furnace bed and highly adapted for burning wastes containing substantially exclusively or abundantly plastics.

SUMMARY OF THE INVENTION

In the burning furnace according to this invention, the grating is made pivotable and a pervious mineral furnace bed acting as a stationary bed during the batchwise combustion is provided on the grating. In this way, power for moving the furnace bed can be dispensed with. A pressure air chamber, preferably of the box construction, is provided below the grating and in the form of the lower part of the furnace. By the provision of the pervious mineral bed and the pressure air chamber, a plenty of necessary burning air for attaining a complete combustion of the batchwise introduced wastes can easily be attained. By virtue of the batchwise combustion service, otherwise necessary large scale appliances are eliminated for the later seive out operation for separating the mineral bed constituents to be reutilized from the unburnt ashes and other solid residuals. Thus, the whole furnace plant is highly simplified.

This and further objects, features and the advantages of the invention can be understood from the following detailed description by consultation with the accompanying drawings.

BRIEF DESCRIPTION OF THE INVENTION

DETAILED DESCRIPTION OF THE INVENTION

Figure 1:
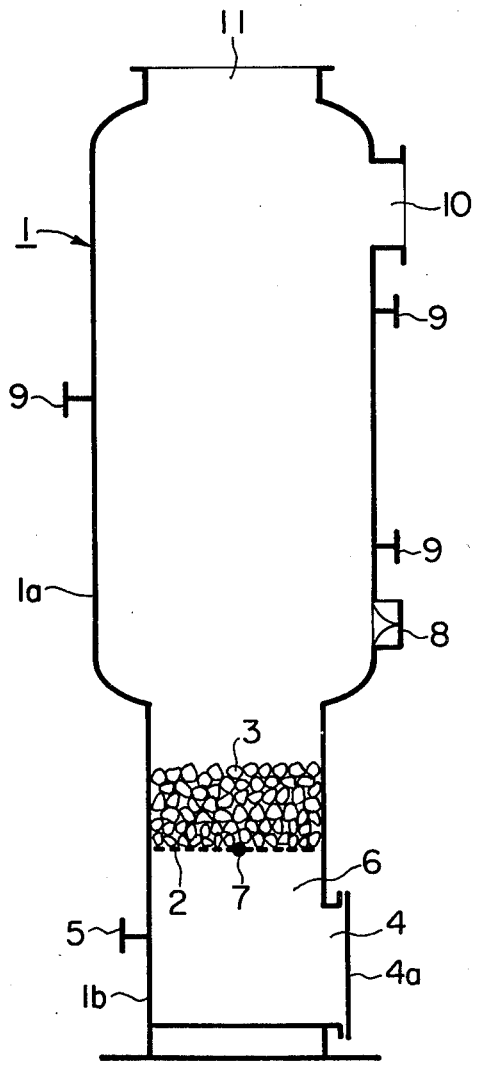
FIG. 1 is a sectional elevation of the first embodiment of the invention.

In the following, the invention will be described more in detail with reference to the accompanying drawings.

Numeral 1 represents generally the wastes burning furnace according to the invention. At an intermediate height of the furnace 1, near the bottom thereof, there is provided normally horizontally a perforated metallic plate 2 which serves as the grating, but in this case, the plate being turnable at least substantially 90 degrees, and if desired 180 or 360 degrees together with a supporting pivot pin 7 which is turnably supported at its both ends in respective bearing means provided on the inside wall surface of the lower reduced furnace part 1*b*, although not specifically shown.

If necessary, the grating 2 is formed with stiffening ribs, not shown, in order to increase its rigidity and load-bearing performance. There is a kind of furnace bed 3 composed of a stack of mineral particles or gravels mounted on the grating 2, the function thereof will be described hereinafter. At a lower level than the grating 2, the reduced furnace shaft 1*b* is formed at one side wall thereof with a laterally directed discharged opening 4 which is normally closed, as shown, by an openable door 4*a*, while at the opposite side wall, an air supply nozzle 5 is provided, which is connected with a compressed air supply source, such as a pressure air reservoir or a compressed air pump or compressor, although not shown. The compressed air chamber thus formed within the reduced lower shaft 1*b* and below the grating 2 is shown with numeral 6.

The perforations of grating 2 are so designed and arranged that air may substantially freely and evenly distributingly pass therethrough while droppage of mineral granules or gravels therethrough is effectively prevented.

Although not shown, the supporting pivot 7 is operatively connected with an operating gear and can be tilted at least 35 degrees or turned to its up and down reversed position, as the case may be.

The top end of the enlarged upper furnace shaft 1*a* is formed with an inlet opening 11 which is covered with an openable door, not shown. This top opening 11 serves for introducing the mineral granules of gravels 3 from above.

The mineral granules or gravels 3 which are naturally incombustible and may consist of natural gravels or artifically broken stone particles, having diametral sizes of 5–50 mm, preferably 8–20 mm. The thickness of the furnace bed 3 may be 50–500 mm, preferably 100–300 mm. Such furnace bed 3 composed of mineral particles described above serves well for establishing better air communication therethrough. In this way, high and considerable air supply rate is assured for supplying pressurized air from the air chamber below the grating therethrough and through the furnace bed 3 into the combustion chamber defined and formed by the main and enlarged upper furnace shaft 1*a*.

Before initiation of the combustion service, the top cover is opened, so as to release the introducing top opening 11.

The mineral particles or gravels are introduced through the now opened top opening 11 onto the grating for the formation of a provisional, yet stationary air-permeable furnace bed layer 3.

Next, combustible wastes are introduced from above through the same opening 11 onto the permeable furnace bed 3 until the wastes accumulate within the main burning space defined within the upper enlarged furnace shaft 1*a*, until the wastes attain an intermediate height or to such a height substantially equal to that of an exhaust gas outlet opening 10 which is formed at a level slightly lower than the furnace top at 11, and leading to a chimney or gas flue (not shown) connected with the outlet opening preferably formed into an outlet socket as shown. In place of the single inlet opening 11, separate respective inlets may be provided, if necessary, for the furnace bed material and the combustible wastes, although not shown. Then, the top opening 11 is closed.

Then, a burner 8 which is attached to the wall of upper furnace shaft 1*a* at a level slightly higher than the open bottom thereof is ignited upon closing the discharge opening 4 and upon operating the pressure air supply nozzle 5. The air chamber 6 formed within the lower furnace shaft 1*b* is kept in pressure, preferably at 100–200 mmHz.

Normally, the supply air has a the normal temperature, but in practice it may have an elevated temperature, preferably 250°–300° C.

During the burning service of the furnace according to this invention, the primary air is continuously supplied to the pressure air chamber and then the air is fed further and upwardly from the said air chamber through the grating and the pervious furnace bed into the combustion chamber above the latter, for continueing the combustion. With provision of such pervious furnace bed, and when the burning wastes include synthetic resin, part of the latter may be brought into its fused state and would clog part or all of the air passage openings in the grating.

With the present furnace provided with the pervious furnace bed, the fused synthetic resin or tarry substance, if any, is completely prevented from its reaching to the air passage openings, and indeed, by the very presence of the furnace bed and thus, a complete combustion can be assured.

The upper and main furnace shaft 1*a* may be provided with a plurality of secondary air supply nozzles 9 for supplying such secondary air when occasion may desire to complete the combustion within the shaft 1*a*. The exhaust gases are discharged from the combustion chamber through the discharge socket 10.

Upon completion of the batchwise combustion, the grating 2 is inclined at least about 35 degrees, so as to let the residual ashes and the mineral furnace bed components to slide off the grating onto the bottom of the air supply chamber. Then, the discharge door 4*a* is opened and the ashes and the provisional mineral bed components are discharged through the opening 4 to outside with a scraper or the like, not shown.

Figure 3:
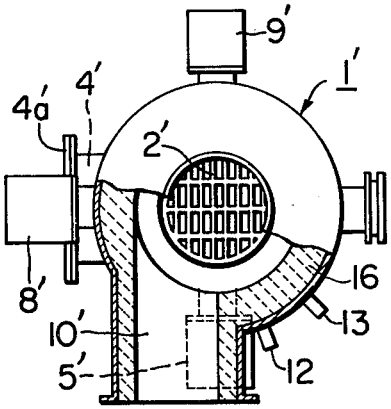
FIG. 3 is a partially sectioned top plan view of the furnace assembly shown in FIG. 2.
Figure 4:
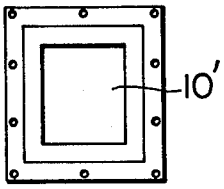
FIG. 4 is a side view of an exhaust gas outlet attached to the furnace assembly.
Figure 2:
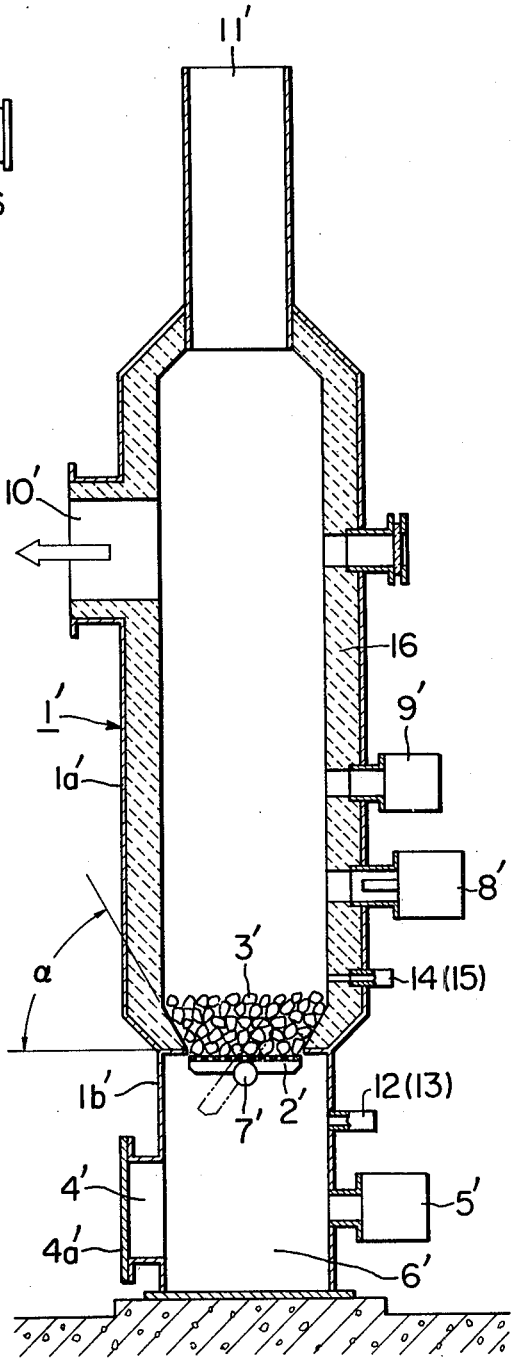
FIG. 2 is a similar elevational section of a somewhat detailed embodiment, wherein, however, several parts thereof are shown as if they be on the elevational plane.

Now, turning to the more specific embodiment shown in FIGS. 2–4, numerals 1'; 1*a'*; 1*b'*; 2'; 4'; 4*a'*; 5'; 6'; 7'; 8'; 9'; 10'; and 11' are those similar parts without prime shown in FIG. 1. The top opening 11' is also fitted with a closable door as before.

Openings 12 and 13 are provided at an intermediate level between the air supply nozzle 5' and the grating 2' for measurement of primary air pressure and -temperature, respectively.

At a slightly higher level above the upper surface of furnace bed 3', there are provided similar openings 14 and 15 for measurement of the burning gas pressure and -temperature, respectively.

The interior surface of the wall of main combustion chamber defined by the upper enlarged furnace shaft 1*a* is lined with fire-resisting brick layer 16 which prevents effectively overheating of the upper surface wall 1*a*′, the bottom part thereof being tapered as shown so as to have an inclination angle alpha amounting to at least 60 degrees, for easy droppage of the mineral particles 3′ when the grating 2′ has been tilted at an inclined angle of at least 35 degrees.

The embodiments of the invention in which an exclusive property or privilege is claimed are as follows:

1. A furnace assembly adapted for combustion of wastes comprising:

wall means defining an enclosed space;

a perforated grating positioned in said enclosed space to divide said space into an upper combustion chamber and a lower chamber;

mounting means for pivotally connecting said grating to said wall means so that said grating is movable between a first, substantially horizontal, position, and a second position angularly spaced from said first position, said grating in said first position receiving a mass of mineral particles acting as a provisional, stationary air-permeable furnace bed for receiving wastes to be combusted; and means for moving said grate from said first to said second position so that said grate is tilted thereby dumping the mass of mineral particles and combustion wastes into said lower chamber.

2. A furnace assembly according to claim 1, further comprising:

means for connecting said lower chamber to a pressurized air source so that said lower chamber comprises a pressure air chamber for feeding air into said upper combustion chamber; and a reclosable opening formed in said lower chamber to facilitate removal of mineral particles and combustion wastes from said lower chamber.

3. A furnace assembly according to claim 2, wherein said wall means includes a tapered portion positioned adjacent and above said grating, said tapered portion directing mineral particles onto said grating and having an inclination angle of at least 60 degrees.

4. A furnace assembly according to claim 2, wherein the wall means includes openings communicating with said upper chamber for introducing secondary combustion air into said upper chamber.

5. A furnace assembly according to claim 1, wherein said wall means includes an opening formed therein and positioned vertically above said grating, said particles and wastes to be combusted being introduced into said enclosed space through said opening.

6. A furnace assembly according to claim 1, wherein said enclosed space has a substantially circular horizontal cross-section, and wherein at least a portion of said upper chamber has a diameter greater than the diameter of said lower chamber.

7. A furnace assembly according to claim 1, wherein said wall means includes a lining formed of fire-resisting brick.

8. A furnace assembly according to claim 1, wherein said grating is a unitary member, and wherein said mounting means comprises a supporting pivot pin turnably supported at its ends by said wall means, said grating being rotatable about said pivot pin.

* * * * *